United States Patent [19]

Saxton

[11] 4,213,848

[45] Jul. 22, 1980

[54] FLUID COKING AND GASIFICATION PROCESS

[75] Inventor: Arthur L. Saxton, Warren, N.J.

[73] Assignee: Exxon Research & Engineering Co., Florham Park, N.J.

[21] Appl. No.: 928,728

[22] Filed: Jul. 27, 1978

Related U.S. Application Data

[63] Continuation-in-part of Ser. No. 806,350, Jun. 14, 1977, abandoned.

[51] Int. Cl.[2] ..... C10G 9/32

[52] U.S. Cl. ..... 208/127; 48/197 R; 208/128

[58] Field of Search ..... 208/127, 128

[56] References Cited

U.S. PATENT DOCUMENTS

| | | | |
|---|---|---|---|
| 2,661,324 | 12/1953 | Leffer | 208/127 |
| 2,734,852 | 2/1956 | Moser | 208/127 |
| 3,475,323 | 10/1969 | Stuckey et al. | 208/127 |
| 3,661,543 | 5/1972 | Saxton | 208/127 |
| 3,671,424 | 6/1972 | Saxton | 208/127 |

*Primary Examiner*—Herbert Levine

*Attorney, Agent, or Firm*—Marthe L. Gibbons

[57] ABSTRACT

The heat requirements of a fluid coking zone are provided by introducing a hot vaporous hydrocarbon stream into the coking zone instead of the conventional hot coke stream. The fluid coking process may be integrated with a coke gasification process.

20 Claims, 3 Drawing Figures

FLUID COKING AND GASIFICATION PROCESS

CROSS REFERENCE TO RELATED APPLICATIONS

This application is a continuation-in-part of U.S. application Ser. No. 806,350, filed June 14, 1977 now abandoned, the teachings of which are hereby incorporated by specific reference.

BACKGROUND OF THE INVENTION

1. Field of the Invention

This invention relates to a method of providing heat to the coking zone of a fluid coking process.

2. Description of the Prior Art

Fluid coking is a well known process which may be carried out with or without recycle of the heavier portion of the fluid coking zone effluent. See, for example, U.S. Pat. No. 2,881,130, the teachings of which are hereby incorporated by reference.

Integrated fluid coking and gasification processes are also known. See, for example, U.S. Pat. Nos. 3,661,543; 3,702,516; 3,759,676, the teachings of which are hereby incorporated by reference.

It is also known to utilize light hydrocarbons to supplement or be used as fluidizing gas in the coking zone and thereby reduce the steam requirements of the process, see, for example, U.S. Pat. Nos. 2,636,844; 2,734,852; 2,863,823 and 3,671,424.

U.S. Pat. No. 2,661,324 discloses a coking process in which heated fine coke particles supply the major portion of the heat requirements of the coking zone. In the embodiment shown in FIG. 1, additionally, a high temperature fluid medium is introduced into the lower portion of the coking chamber for stripping the coke.

In the conventional fluid coking process and in the integrated fluid coking and gasification processes, the major portion of the heat requirements of the coking zone are provided by a recycled stream of hot solids, generally coke particles which are heated by the exothermic reaction of oxygen with coke in the burner of a conventional fluid coker or in the gasifier of the integrated coking and gasification process. It has now been found advantageous to utilize a hot vaporous hydrocarbon stream to provide the heat requirements of the coking zone, instead of utilizing recycled solids. The benefits are derived from minimizing or eliminating certain requirements which are associated with the recycled solids stream, and from other effects which are associated with the recycled hydrocarbon stream. The main advantages are summarized below and will be apparent in the description which follows.

Some lighter-than-coke hydrocarbon material is transported with the recycled coke stream from the coking zone into a conventional coke burner or into the heater of an integrated coking and gasification unit. This constitutes a loss of potential overhead product from the coking zone, which will be recovered when the light hydrocarbon recycle heating method of the present invention is used. Similarly, the recycled coke transports some gases containing nitrogen and carbon oxides into the coking reactor from which they pass overhead and contaminate the coker products. This product contamination is avoided with the light hydrocarbon recycle heating system of the present invention.

Recycling the solids stream requires that a substantial quantity of steam, or other lift gas, be used in the upflowing portion of each solids circuit. There are energy debits associated with the supply of these lift gas streams, and with the heating and subsequent cooling of the lift gas within the process system. These debits are eliminated with the recycle hydrocarbon heating system of the present invention.

The recycled hydrocarbon moles will be sufficient to maintain good fluidization throughout the entire coking zone and will eliminate the need for the reactor stripping and fluidization steam employed in conventional commercial units heated by recycled solids.

SUMMARY OF THE INVENTION

In accordance with the invention there is provided, in a fluid coking process comprising the step of reacting a carbonaceous material in a coking zone containing a bed of fluidized solids maintained in a fluidized state by the introduction of a fluidizing gas, at fluid coking conditions, to form a coking zone vapor phase conversion product and coke, the improvement which comprises introducing into said coking zone hot light hydrocarbons in an amount and at a temperature sufficient to provide substantially all of the heat requirement of said coking zone.

In accordance with another embodiment of the invention there is provided, in an integrated coking and gasification process comprising the steps of:

(a) reacting a carbonaceous material in a coking zone containing a bed of fluidized solids maintained in fluidized state by the introduction of a fluidizing gas, at fluid coking conditions, to form a coking zone vapor phase conversion product and coke, said coke depositing on said fluidized solids;

(b) contacting a portion of said solids with steam and a molecular oxygen-containing gas in a fluid bed gasification zone maintained at gasification conditions to produce a gaseous product, the improvement which comprises introducing into said coking zone hot light hydrocarbons in an amount and at a temperature sufficient to provide substantially all of the heat requirement of said coking zone.

DESCRIPTION OF THE PREFERRED EMBODIMENTS

Figure 1:
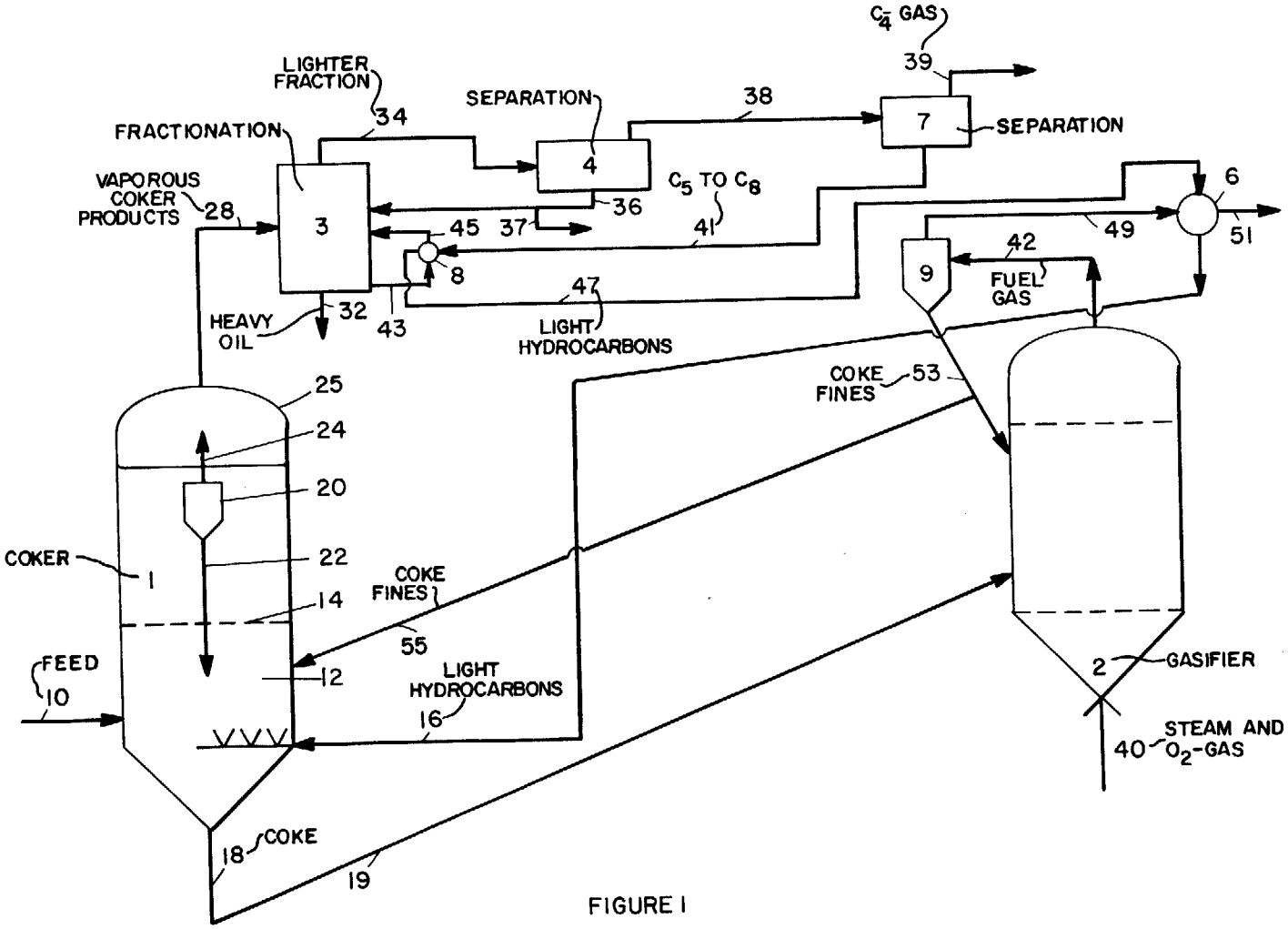
FIG. 1 is a schematic flow plan of one embodiment of the invention.

The preferred embodiments will be described with reference to the accompanying figures. Referring to FIG. 1, a carbonaceous material is passed by line 10 into a coking zone 12 of coking reactor 1 in which is maintained a fluidized bed of solids (e.g., coke particles of 40 to 1000 microns in size) having an upper level indicated at 14. Carbonaceous feeds suitable for the coking zone of the present invention include heavy hydrocarbonaceous oils, such as oils having a Conradson carbon residue of at least about 5 weight percent, generally from about 5 to about 50 weight percent, preferably above about 7 weight percent (as to Conradson carbon residue, see ASTM test D-189-65); heavy and reduced petroleum crude oils; petroleum atmospheric distillation bottoms; petroleum vacuum distillation bottoms; pitch; asphalt; bitumen; other heavy hydrocarbon residues; coal; coal slurry; liquid products derived from coal liquefaction processes and mixtures of these feeds. In commercial fluid coking processes, a fluidizing gas such as steam is admitted at the base of the coking reactor 1 in an amount which is at least sufficient to obtain a superficial fluidizing gas velocity in the range of 0.5 to 5 feet per second. This gas also serves as a stripping medium to remove occluded hydrocarbons from the coke which circulates to the heater. In accordance with the present invention, light hydrocarbons in vapor phase are introduced via line 16 in an amount and at a temperature sufficient to provide substantially all of the heat required in the coking zone. These hydrocarbon vapors will also serve as fluidizing gas. A stream of small particle size solids, such as coke solids collected in cyclones (to be described later), may also be introduced into the coker to provide "seed" particles.

The quantity and temperature of the light hydrocarbons needed to provide the desired amount of heat can readily be calculated for the temperature desired to be maintained in the coking zone. Suitable light hydrocarbons for use as heat source and fluidizing gas include normally gaseous hydrocarbons, such as $C_1$ to $C_4$ gases, vaporized normally liquid hydrocarbons such as $C_5$ to $C_8$ hydrocarbons. Preferably, the light hydrocarbon is a stream boiling at atmospheric pressure between about 50° to 300° F., recovered from the coker reaction products. The light hydrocarbon used as heat source and fluidizing gas is generally introduced into the coking zone at a temperature from about 100 to 400 Fahrenheit degrees in excess of the actual operating temperature of the coking zone. The coking zone is generally maintained at a temperature in the range of about 850° to about 1100° F. and at a pressure ranging from about 5 to about 200 pounds per square inch gauge (psig), preferably in the range of 5 to 45 psig. Contact of the feed with the hot fluidized solids in the coking zone under fluid coking conditions produces a vapor phase conversion product including normally gaseous and normally liquid hydrocarbons, and coke which deposits on the fluidized solids. A stream of solids with coke deposition thereon is withdrawn from the coker by line 18 and passed to a fluid bed gasification zone in gasifier 2. The conversion products are passed through cyclone 20 to remove entrained solids which are returned to the coking zone through dipleg 22. The vapors leave the cyclone through line 24 and pass into a scrubber 25 mounted on the coker. If desired, a stream of heavy material condensed in the scrubber may be recycled to the coker.

The coker conversion products are removed from scrubber 25 via line 28 to a fractionation zone 3. A heavy oil fraction is recovered from fractionator 3 by line 32.

A lighter fraction is removed from the fractionator by line 34 and passed to a separation zone 4. The bottoms portion, that is, a light oil, is removed from separation zone 4 and passed to fractionation zone 3 via line 36. A portion of this stream is recovered as product via line 37. A stream is removed from fractionation zone 3 via line 43 then through a heat exchanger 8. This pumparound stream is returned to fractionation zone 3 via line 45. The overhead stream of separation zone 4 is passed via line 38 to separation zone 7. A $C_4^-$ gas stream is removed from separation zone 7 via line 39. A light hydrocarbon stream comprising components ranging from $C_5$ to $C_8$ is removed from separation zone 7 via line 41 and passed through heat exchanger 8. The light hydrocarbon stream passes from heat exchanger 8 via line 47 through heat exchanger 6. The light hydrocarbon stream is then recycled to the coking zone via line 16 as previously described to provide substantially all of the heat required in the coking zone and to serve as fluidizing gas, preferably as sole added fluidizing gas. The expression "substantially all the heat requirement of the coking zone" herein is not intended to exclude the conventional preheating of the feedstock of the coking zone. It should be noted that when the feedstock is preheated, it is heated to below coking reaction temperature since it is desired to avoid coking to occur in the conduits leading into the coker to prevent plugging of the conduits. The light hydrocarbon stream, which is recycled to the coking zone to provide the heat which is typically provided in prior art coking processes by a hot stream of circulating coke, is introduced into the coking zone at a temperature above the actual operating temperature of the coking zone, generally at a temperature from about 100 to about 400 Fahrenheit degrees in excess of the actual operating temperature of the coking zone.

Returning to gasifier 2, solids with a coke deposition thereon are introduced into fluid bed gasification zone by line 19. The gasification zone is maintained at a temperature ranging from about 1400° to 2000° F., preferably from about 1600° to 1800° F. and at a pressure ranging from about 5 to about 200 psig, preferably from about 10 to about 60 psig. Steam and a molecular oxygen-containing gas such as air, commercial oxygen or air enriched with oxygen are introduced into the gasification zone by line 40. Reaction of the coke in the gasification zone with the steam and oxygen-containing gas produces a hydrogen-containing fuel gas. The composition of this gas will vary depending upon the actual operating conditions of the gasification zone. The gasifier product gas is passed via line 42 from the gasifier to cyclone 9 where entrained coke fines are separated from the gas. The gas stream passes from cyclone 9 via line 49 to heat exchanger 6 thereby heating by indirect heat exchange the light hydrocarbon stream of line 47. The gas is recovered via line 51. The coke fines which are separated from the gas in cyclone 9 are removed from cyclone 9 via line 53. If desired, a portion of these fines may be returned to the gasifier and/or a portion of the fines may be passed to the coking zone via line 55 as "seed" particles.

While the fluid coking process has been described for simplicity of description to use of circulating coke as the fluidized solid particles, it is to be understood that the fluidized seed particles on which the coke is deposited may be silica, alumina, zirconia, magnesia, calcium oxide, alundum, mullite, bauxite or the like. The fluidized solids may or may not be catalytic in nature.

Figure 2:
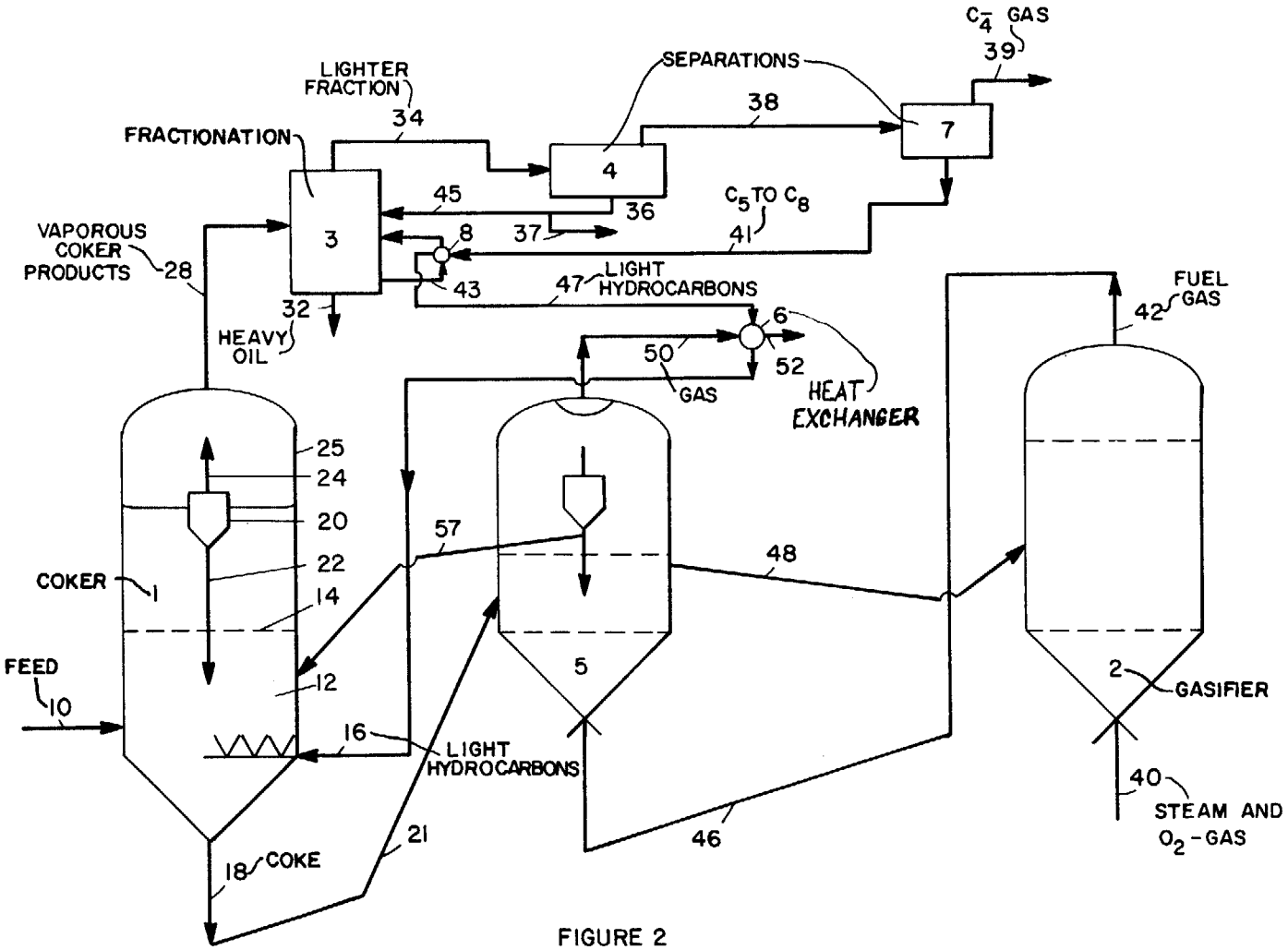
FIG. 2 is a schematic flow plan of a second embodiment of the invention.

FIG. 2 differs from FIG. 1 in that the portion of solids removed from coker 1 by line 18 is passed to an additional fluid bed zone in vessel 5. The hot gasifier product gas is introduced into vessel 5 by line 46. In vessel 5, the hot gas contacts the colder solids and heats them by heat exchange. The temperature in vessel 5 generally ranges from about 1200° to about 1600° F. The fluidized bed in vessel 5 is maintained at a pressure ranging from about 5 to about 200 psig. The gaseous effluent of vessel 5 is removed via line 50 and passed through heat exchanger 6 to provide the heat for heating the recycle light hydrocarbon stream. A stream of solids is passed via line 48 to gasifier 2. Furthermore in the FIG. 2 embodiment, the gasifier product gas is not passed through an external cyclone. Coke fines are passed from the dipleg of the cyclone in vessel 5 via line 57 to the coking zone.

Figure 3:
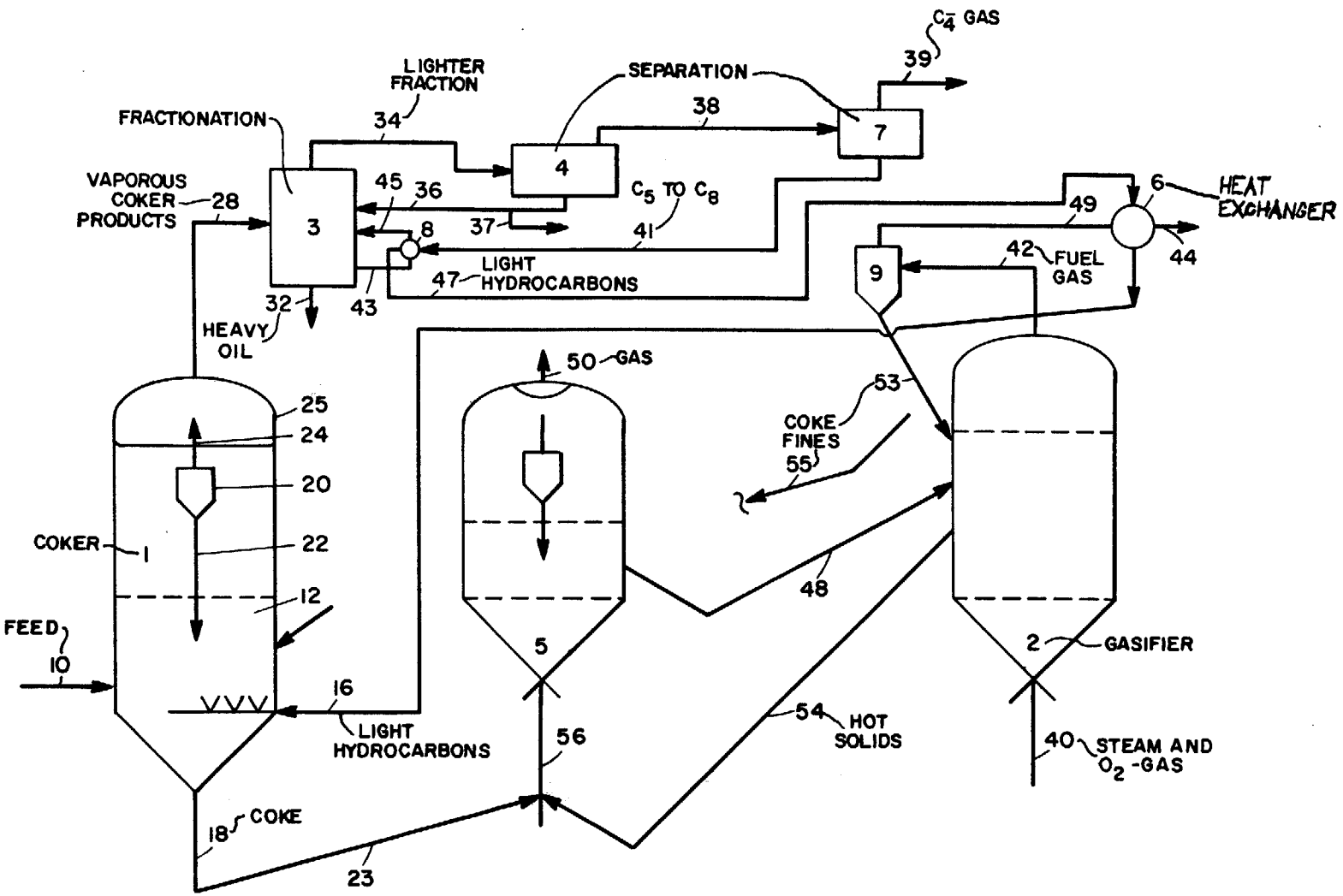
FIG. 3 is a schematic flow plan of a third embodiment of the invention.

FIG. 3 differs from FIG. 2 in that the gaseous product of the gasifier is passed through heat exchanger 6 to heat the recycle light hydrocarbon stream and a hydrogen and methane-rich gas product is produced in vessel 5 by secondary cracking of the gross coke deposited in the coking zone. A stream of hot solids is withdrawn from the gasifier via line 54 and introduced into line 56 together with a stream of colder solids from the coking zone via line 18 and line 23. The combined solid stream is introduced into vessel 5 via line 56 at a mixed temperature in the range of 1400° to 1600° F. This temperature influences the yield of hydrogen and methane-rich gas from thermal cracking, and is controlled by regulating the rate of hot solids recycled via line 54. The gaseous effluent of vessel 5 is removed via line 50. Seed particles are returned from the gasifier to the coker as described regarding FIG. 1.

The heating method of the present invention by a hot vaporous hydrocarbon stream is suitable for heating the coking zone of a conventional fluid coking process as well as the fluid coking zone of an integrated fluid coking and gasification process. Sources of heat input to a recycled hydrocarbon stream would include the hot pumparound reflux condensers on the coker product fractionator, the hot flue gas from the coke burner, and/or a fired furnace.

What is claimed is:

1. In a fluid coking process comprising the step of reacting a preheated carbonaceous material feedstock in a coking zone containing a bed of fluidized solids maintained in a fluidized state by the introduction of a fluidizing gas, at fluid coking conditions, to form a coking zone vapor phase conversion product and coke, the improvement which comprises introducing into said coking zone hot light hydrocarbons in an amount and at a temperature sufficient to provide substantially all of the heat requirement of said coking zone above that provided by the preheated feedstock, in the absence of recycled hot solids.

2. The process of claim 1 wherein said hot light hydrocarbons are introduced into said coking zone at a temperature from about 100 to about 400 Fahrenheit degrees in excess of the actual operating temperature of said coking zone.

3. In the process of claim 1 wherein the coking zone vapor phase product is separated into fractions including a light hydrocarbon fraction, the further improvement which comprises recycling said light hydrocarbon fraction to said coking zone.

4. The process of claim 3 wherein said light hydrocarbon fraction is reheated prior to being recycled to said coking zone.

5. The process of claim 1 wherein said light hydrocarbons are selected from the group consisting of $C_1$ to $C_4$ hydrocarbon gases, $C_5$ to $C_8$ normally liquid hydrocarbons, hydrocarbon mixtures boiling at atmospheric pressure from about 50° F. to about 300° F. and mixtures thereof.

6. The process of claim 1 wherein said hot light hydrocarbons are normally liquid hydrocarbons.

7. The process of claim 1 wherein said coking zone temperature ranges from about 850° to about 1100° F.

8. In an integrated coking and gasification process comprising the steps of:

(a) reacting a preheated carbonaceous material feedstock in a coking zone containing a bed of fluidized solids maintained in fluidized state by the introduction of a fluidizing gas, at fluid coking conditions, to form a coking zone vapor phase conversion product and coke, said coke depositing on said fluidized solids;

(b) contacting a portion of said solids with steam and a molecular oxygen-containing gas in a fluid bed gasification zone maintained at gasification conditions to produce a gaseous product, the improvement which comprises introducing into said coking zone hot light hydrocarbons in an amount and at a temperature sufficient to provide substantially all of the heat requirement of said coking zone above that provided by the preheated feedstock, in the absence of recycled hot solids.

9. The process of claim 8 wherein said hot light hydrocarbons are introduced into said coking zone at a temperature from about 100 to about 400 Fahrenheit degrees in excess of the actual operating temperature of said coking zone.

10. In the process of claim 8 wherein the coking zone vapor phase product is separated into fractions including a light hydrocarbon fraction, the further improvement which comprises recycling said light hydrocarbon fraction to the said coking zone.

11. The process of claim 10 wherein said light hydrocarbon fraction is reheated prior to being recycled to said coking zone.

12. The process of claim 11 wherein said light hydrocarbon fraction is reheated by heat exchange with one of the product streams prior to being recycled into said coking zone.

13. The process of claim 8 wherein said light hydrocarbons are selected from the group consisting of $C_1$ to $C_4$ hydrocarbon gases, $C_5$ to $C_8$ normally liquid hydrocarbons, hydrocarbon mixtures boiling, at atmospheric pressure, from about 50° F. to about 300° F. and mixtures thereof.

14. In the process of claim 8, the additional steps which comprise passing a portion of said solids from said coking zone and passing the gaseous product of said gasification zone to an additional fluidized bed zone wherein said portion of solids is heated by contact with said gaseous product and passing a portion of solids from said additional fluid bed zone to said gasification zone.

15. In the process of claim 8, the additional steps which comprise passing a portion of the solids from the gasification zone and a portion of the solids from said coking zone to an additional fluidized bed zone to heat the coking zone solids, and passing a portion of heated solids from said additional fluidized bed zone to said gasification zone.

16. The process of claim 8 wherein said coking zone is maintained at a temperature ranging from about 850° F. to about 1100° F. and at a pressure ranging from about 5 to about 200 psig.

17. The process of claim 8 wherein said gasification zone is maintained at a temperature ranging from about 1400° F. to about 2000° F. and at a pressure ranging from about 5 to about 200 psig.

18. The process of claim 8 wherein said gasification zone is maintained at a temperature ranging from about 1600° F. to about 1800° F.

19. The process of claim 14 wherein said additional fluidized bed zone is maintained at a temperature ranging from about 1200° F. to about 1600° F. and at a pressure ranging from about 5 to about 200 psig.

20. The process of claim 8 wherein said hot light hydrocarbons are introduced into said coking zone as sole added fluidizing gas.

* * * * *